US008646613B2

(12) United States Patent
Reiger et al.

(10) Patent No.: US 8,646,613 B2
(45) Date of Patent: Feb. 11, 2014

(54) METHOD FOR CONCENTRATING MAGNETICALLY SEPARATED COMPONENTS FROM ORE SUSPENSIONS AND FOR REMOVING SAID COMPONENTS FROM A MAGNETIC SEPARATOR AT A LOW LOSS RATE

(75) Inventors: Reinhold Reiger, Offstein (DE); Juergen Oswald, Frankenthal (DE)

(73) Assignees: BASF SE, Ludwigshafen (DE); Siemens Aktiengesellschaft, München (DE)

( * ) Notice: Subject to any disclaimer, the term of this patent is extended or adjusted under 35 U.S.C. 154(b) by 0 days.

(21) Appl. No.: 13/504,519

(22) PCT Filed: Nov. 10, 2010

(86) PCT No.: PCT/EP2010/067172
§ 371 (c)(1),
(2), (4) Date: Apr. 27, 2012

(87) PCT Pub. No.: WO2011/058033
PCT Pub. Date: May 19, 2011

(65) Prior Publication Data

US 2012/0211403 A1 Aug. 23, 2012

(30) Foreign Application Priority Data

Nov. 11, 2009 (EP) ..... 09175643

(51) Int. Cl.
*B03C 1/00* (2006.01)

(52) U.S. Cl.
USPC ..... 209/212; 209/213; 209/214; 209/215; 209/223.2; 209/232

(58) Field of Classification Search
USPC ..... 209/636, 212, 213, 214, 215, 223.1, 209/223.2, 232
See application file for complete search history.

(56) References Cited

U.S. PATENT DOCUMENTS

| | | | |
|---|---|---|---|
| 2010/0200510 | A1 | 8/2010 | Domke et al. |
| 2010/0300941 | A1 | 12/2010 | Domke et al. |
| 2010/0307982 | A1 | 12/2010 | Domke et al. |
| 2011/0163014 | A1 | 7/2011 | Bender et al. |
| 2012/0125858 | A1 | 5/2012 | Hartmann et al. |

FOREIGN PATENT DOCUMENTS

| | | |
|---|---|---|
| CA | 2 718 163 | 9/2009 |
| DE | 2 210 029 | 9/1972 |

(Continued)

OTHER PUBLICATIONS

U.S. Appl. No. 13/434,176, filed Mar. 29, 2012, Deuerlein, et al.

(Continued)

*Primary Examiner* — David H Bollinger
(74) *Attorney, Agent, or Firm* — Oblon, Spivak, McClelland, Maier & Neustadt, L.L.P.

(57) ABSTRACT

The present invention relates to a process for separating magnetic constituents from an aqueous dispersion comprising these magnetic constituents and nonmagnetic constituents by passing the aqueous dispersion through a reactor space in which the aqueous dispersion is separated by means of a magnet installed on the outside of the reactor space into at least one stream I comprising the magnetic constituents and at least one stream II comprising the nonmagnetic constituents, wherein the magnetic constituents in stream I are treated with a flushing stream, a reactor comprising a reactor space, at least one magnet installed on the outside of the reactor space, at least one inlet, at least one outlet for a stream I and at least one outlet for a stream II and at least one facility for treating stream I with a flushing stream, and also the use of this reactor in the process of the invention.

14 Claims, 5 Drawing Sheets

(56) References Cited

FOREIGN PATENT DOCUMENTS

| | | |
|---|---|---|
| JP | 61 153117 | 7/1986 |
| RU | 2 348 446 | 3/2009 |
| WO | 2009 010422 | 1/2009 |
| WO | 2009 030669 | 3/2009 |
| WO | 2009 065802 | 5/2009 |

OTHER PUBLICATIONS

International Search Report Issued Jan. 28, 2011 in PCT/EP10/67172 Filed Nov. 10, 2010.

U.S. Appl. No. 13/509,413, filed May 11, 2012, Rieger, et al.

METHOD FOR CONCENTRATING MAGNETICALLY SEPARATED COMPONENTS FROM ORE SUSPENSIONS AND FOR REMOVING SAID COMPONENTS FROM A MAGNETIC SEPARATOR AT A LOW LOSS RATE

The present invention relates to a process for separating magnetic constituents from an aqueous dispersion comprising these magnetic constituents and nonmagnetic constituents by passing the aqueous dispersion through a reactor space in which the aqueous dispersion is separated by means of a magnet installed on the outside of the reactor space into at least one stream I comprising the magnetic constituents and at least one stream II comprising the nonmagnetic constituents, wherein the magnetic constituents in stream I are treated with a flushing stream, a reactor comprising a reactor space, at least one magnet installed on the outside of the reactor space, at least one inlet, at least one outlet for a stream I and at least one outlet for a stream II and at least one facility for treating stream I with a flushing stream, and also the use of this reactor in the process of the invention.

In particular, the present invention relates to a process and a reactor for separating naturally occurring ores so that the ore mineral is obtained in very high purity. A person skilled in the art will know that naturally occurring ores can be worked up by treating them, if appropriate after comminution, with magnetic particles, so that agglomerates of ore mineral and magnetic particles are formed as a result of the natures of the surfaces of the ore mineral and the magnetic particles and these agglomerates, which in contrast to the remaining gangue are magnetic, can be separated off by action of a magnetic field.

Processes for separating such magnetic constituents from a mixture, in particular an aqueous dispersion, comprising these magnetic constituents and also nonmagnetic constituents are known to those skilled in the art.

According to the prior art, it is possible, for example, to convey the aqueous dispersion to be separated past a magnetic, rotating drum. As a result of the magnetic attraction between magnetic drum and the magnetic constituents, the latter adhere to the drum and are separated from the aqueous dispersion to be separated by the rotational motion. The nonmagnetic constituents are, owing to the lack of attraction, not fixed to the drum so that they remain in the dispersion. The magnetic constituents can be detached from the magnetic drum by using, for example, mechanical scrapers which detach the magnetic constituents from the drum. It is also possible, according to the prior art, to control the magnetic action on the rotating drum, by, for example after the magnetic constituents have been removed from the dispersion by the rotating drum, switching off the magnetic field so that the magnetic constituents no longer adhere to the drum and can be collected. According to the prior art, the dispersion to be separated can be conveyed in cocurrent with the rotational motion of the drum. Processes in which the stream of aqueous dispersion is conveyed in counter current to the direction of rotation of the drum are also known in the prior art.

The processes known from the prior art generally have the disadvantage that only an unsatisfactory separating action is achieved since nonmagnetic gangue is also incorporated in the magnetic agglomerates adhering to the magnetic drum. This gangue is in this way likewise separated off from the dispersion. The nonmagnetic constituents remain in the material of value after the magnetic agglomerates have been separated off and in the later work-up of the ore mineral, for example by smelting, lead to unfavorable space-time yields and thus to increased costs in the overall process. The use of a rotating magnetic roller does not, according to the prior art, make it possible for the proportion of nonmagnetic constituents to be effectively reduced.

It is therefore an object of the present invention to provide a process for separating magnetic constituents from an aqueous dispersion comprising these magnetic constituents and nonmagnetic constituents, in which a very small proportion of nonmagnetic constituents is separated off, for example by attachment to the magnetic constituents, together with the magnetic constituents comprising, for example, the desired ore mineral so as to increase the efficiency of the process.

A further object is to minimize the proportion of nonmagnetic constituents which are separated off unintentionally in order to achieve high space-time yields in a subsequent work-up of the magnetic constituents, in particular the ore minerals. Furthermore, it is advantageous if a very small proportion of nonmagnetic constituents is present in the fraction separated off, since, particularly in the separation of naturally occurring ores, the nonmagnetic constituents comprise essentially oxidic compounds which in a work-up of the ore mineral by smelting are obtained as slag and have an adverse effect on the smelting process. It is therefore also an object of the present invention to provide a process for separating naturally occurring ores so that a very small amount of slag is obtained in a subsequent smelting process.

These objects are achieved according to the invention by a process for separating magnetic constituents from an aqueous dispersion comprising these magnetic constituents and nonmagnetic constituents by passing the aqueous dispersion through a reactor space in which the aqueous dispersion is separated by means of at least one magnet installed on the outside of the reactor space into at least one stream I comprising the magnetic constituents and at least one stream II comprising the nonmagnetic constituents, wherein the magnetic constituents in stream I are treated with a flushing stream.

According to the invention, the objects are also achieved by a reactor comprising a reactor space, at least one magnet installed on the outside of the reactor space, at least one inlet, at least one outlet for a stream I, at least one outlet for a stream II and at least one facility for treating stream I with a flushing stream, and also by the use of this reactor in the process of the invention.

The process of the invention is described in detail below:

The process of the invention serves to separate magnetic constituents from an aqueous dispersion comprising these magnetic constituents and nonmagnetic constituents.

According to the invention, the process can in general be employed for separating all magnetic constituents from nonmagnetic constituents which form a dispersion in water.

In a preferred embodiment, the process of the invention serves to separate aqueous dispersions which originate from the work-up of naturally occurring ores.

In a preferred embodiment of the process of the invention, the aqueous dispersion to be separated comes from the following process for separating at least one first material from a mixture comprising this at least one first material and at least one second material, with the at least two materials being separated from one another by treating the mixture in aqueous dispersion with at least one magnetic particle, resulting in the at least one first material and the at least one magnetic particle agglomerating and thus forming the magnetic constituents of the aqueous dispersion and the at least one second material and the at least one magnetic particle not agglomerating so that the at least one second material preferably forms the nonmagnetic constituents of the aqueous dispersion.

The agglomeration of at least one first material and at least one magnetic particle to form the magnetic constituents occurs as a result of attractive interactions between these particles.

According to the invention, it is possible, for example, for said particles to agglomerate because the surface of the at least one first material is intrinsically hydrophobic or is hydrophobicized by treatment with at least one surface-active substance, if appropriate additionally. Since the magnetic constituents likewise either themselves have a hydrophobic surface or are hydrophobicized, if appropriate additionally, said particles agglomerate as a result of the hydrophobic interactions. Since the at least one second material preferably has a hydrophilic surface, the magnetic particles and the at least one second material do not agglomerate. A process forming these magnetic agglomerates is described, for example, in WO 2009/030669 A1. For all details of this process, reference is expressly made to this first publication.

For the purposes of the present invention, "hydrophobic" means that the corresponding particle can have been hydrophobicized subsequently by treatment with the at least one surface-active substance. It is also possible for an intrinsically hydrophobic particle to be additionally hydrophobicized by treatment with the at least one surface-active substance.

"Hydrophobic" means, for the purposes of the present invention, that the surface of a corresponding "hydrophobic substance" or a "hydrophobicized substance" has a contact angle of >90° with water against air. "Hydrophilic" means, for the purposes of the present invention, that the surface of a corresponding "hydrophilic substance" has a contact angle of <90° with water against air.

The formation of magnetic agglomerates, i.e. the magnetic constituents which can be separated off by the process of the invention, can also occur via other attractive interactions, for example via the pH-dependent zeta potential of the corresponding surfaces, see, for example, the International publications WO 2009/010422 and WO 2009/065802.

In a preferred embodiment of the process of the invention, the at least one first material which together with magnetic particles forms the magnetic constituents is at least one hydrophobic metal compound or coal and the at least one second material which forms the nonmagnetic constituents is preferably at least one hydrophilic metal compound.

The at least one first material is particularly preferably a metal compound selected from the group consisting of sulfidic ores, oxidic and/or carbonate-comprising ores, for example azurite $[Cu_3(CO_3)_2(OH)_2]$ or malachite $[Cu_2[(OH)_2|CO_3]]$), or noble metals to which a surface-active compound can bind selectively to produce hydrophobic surface properties.

The at least one second material is particularly preferably a compound selected from the group consisting of oxidic and hydroxidic compounds, for example silicon dioxide $SiO_2$, silicates, aluminosilicates, for example feldspars, for example albite $Na(Si_3Al)O_8$, mica, for example muscovite $KAl_2[(OH,F)_2AlSi_3O_{10}]$, garnets $(Mg, Ca, Fe^{II})_3(Al, Fe^{III})_2(SiO_4)_3$, $Al_2O_3$, FeO(OH), $FeCO_3$ and further related minerals and mixtures thereof. This at least one hydrophilic metal compound is itself nonmagnetic and also does not become magnetic by attachment of at least one magnetic particle. The at least one hydrophilic metal compound thus forms, in a preferred embodiment, the nonmagnetic constituents of the dispersion to be separated.

Examples of sulfidic ores which can be used according to the invention are, for example, selected from the group of copper ores, consisting of covellite CuS, chalcopyrite (copper pyrite) $CuFeS_2$, bornite $Cu_5FeS_4$, chalcocite (copper glance) $Cu_2S$ and mixtures thereof, and also other sulfides such as molybdenum (IV) sulfide and pentlandite ($NiFeS_2$).

Suitable oxidic metal compounds which can be used according to the invention are preferably selected from the group consisting of silicon dioxide $SiO_2$, silicates, aluminosilicates, for example feldspars, for example albite $Na(Si_3Al)O_8$, mica, for example muscovite $KAl_2[(OH,F)_2AlSi_3O_{10}]$, garnets $(Mg, Ca, Fe^{II})_3(Al, Fe^{III})_2(SiO_4)_3$ and further related minerals and mixtures thereof.

Accordingly, the process of the invention is preferably carried out using ore mixtures which have been obtained from mined deposits and have been treated with appropriate magnetic particles.

In a preferred embodiment of the process of the invention, the mixture comprising at least one first material and at least one second material is present in the form of particles having a size of from 100 nm to 200 μm in step (A), see, for example, U.S. Pat. No. 5,051,199. Preferred ore mixtures have a content of sulfidic materials of at least 0.01% by weight, preferably 0.5% by weight and particularly preferably at least 3% by weight.

Examples of sulfidic minerals which are present in the mixtures which can be used according to the invention are those mentioned above. In addition, sulfides of metals other than copper can also be present in the mixtures, for example sulfides of iron, lead, zinc or molybdenum, i.e. $FeS/FeS_2$, PbS, ZnS or $MoS_2$. Furthermore, oxidic compounds of metals and semimetals, for example silicates or borates, or other salts of metals and semimetals, for example phosphates, sulfates or oxides/hydroxides/carbonates and further salts, for example azurite $[Cu_3(CO_3)_2(OH)_2]$, malachite $[Cu_2[(OH)_2(CO_3)]]$, barite ($BaSO_4$), monazite ($(La—Lu)PO_4$), can be present in the ore mixtures to be treated according to the invention. Further examples of the at least one first material which is separated off by the process of the invention are noble metals, for example Au, Pt, Pd, Rh etc., which can be present in the native state, as alloy or in associated form.

To form the magnetic constituents of the aqueous dispersion to be treated according to the invention, the at least one first material from the abovementioned group is brought into contact with at least one magnetic particle in order to obtain the magnetic constituents by attachment or agglomeration. In general, the magnetic constituents can comprise all magnetic particles known to those skilled in the art.

In a preferred embodiment, the at least one magnetic particle is selected from the group consisting of magnetic metals, for example iron, cobalt, nickel and mixtures thereof, ferromagnetic alloys of magnetic metals, for example NdFeB, SmCo and mixtures thereof, magnetic iron oxides, for example magnetite, maghemite, cubic ferrites of the general formula (I)

$$M^{2+}{}_xFe^{2+}{}_{1-x}Fe^{3+}{}_2O_4 \quad (I)$$

where

M is selected from among Co, Ni, Mn, Zn and mixtures thereof and $x \leq 1$, hexagonal ferrites, for example barium or strontium ferrite $MFe_6O_{19}$ where M=Ca, Sr, Ba, and mixtures thereof. The magnetic particles can additionally have an outer layer, for example of $SiO_2$.

In a particularly preferred embodiment of the present patent application, the at least one magnetic particle is magnetite or cobalt ferrite $Co^{2+}{}_xFe^{2+}{}_{1-x}Fe^{3+}{}_2O_4$ where $x \leq 1$.

In a preferred embodiment, the magnetic particles used in the magnetic constituents are present in a size of from 100 nm to 200 μm, particularly preferably from 1 to 50 μm.

In the aqueous dispersion to be treated according to the invention, the magnetic constituents, i.e. preferably the agglomerates of magnetic particle and ore mineral, are generally present in an amount which allows the aqueous dispersion to be transported or conveyed by means of methods and apparatuses known to those skilled in the art. The aqueous dispersion to be treated according to the invention preferably comprises from 0.01 to 10% by weight, particularly preferably from 0.2 to 2% by weight, very particularly preferably from 0.5 to 1% by weight, in each case based on the total aqueous dispersion, of magnetic constituents.

In the aqueous dispersion to be treated according to the invention, the nonmagnetic constituents are generally present in an amount which allows the aqueous dispersion to be transported or conveyed by means of methods and apparatuses known to those skilled in the art. The aqueous dispersion to be treated according to the invention preferably comprises from 5 to 50% by weight, particularly preferably from 10 to 45% by weight, very particularly preferably from 20 to 40% by weight, in each case based on the total aqueous dispersion, of nonmagnetic constituents.

According to the invention, an aqueous dispersion is treated, i.e. the dispersion medium is essentially water, for example from 50 to 95% by weight, preferably from 55 to 90% by weight, in each case based on the total aqueous dispersion.

However, the process can also be applied to nonaqueous dispersions or mixtures of solvents with water.

Thus, further dispersion media, for example alcohols such as methanol, ethanol, propanols, for example n-propanol or isopropanol, butanols, for example n-butanol, isobutanol or tert-butanol, other organic solvents such as ketones, for example acetone, ethers, for example dimethyl ether, methyl tert-butyl ether, mixtures of aromatics such as naphtha or diesel or mixtures of two or more of the abovementioned solvents, can be present in addition to or instead of water. The dispersion media present in addition to water are present in an amount of up to 95% by weight, preferably up to 80% by weight, in each case based on the total dispersion.

The amounts indicated for the individual components present in the aqueous dispersion to be treated according to the invention in each case add up to 100% by weight.

In a very particularly preferred embodiment, an aqueous dispersion which does not comprise any further dispersion medium in addition to water is treated by the process of the invention.

The process of the invention is therefore very particularly preferably used for treating an aqueous dispersion comprising from 0.2 to 4% by weight, preferably from 0.4 to 2% by weight, particularly preferably from 0.5 to 1% by weight, of particles of magnetite as magnetic constituents and from 0.2 to 4% by weight, preferably from 0.4 to 2% by weight, particularly preferably from 0.5 to 1% by weight, of particles of one of the abovementioned sulfides as nonmagnetic constituents and water as balance to 100% by weight.

The process of the invention comprises passing the aqueous dispersion through a reactor space. According to the invention, it is possible to give the reactor space any configuration as long as it is ensured that the aqueous dispersion to be separated has sufficient contact with the at least one magnet installed on the outside of the reactor space or the magnetic field produced by this at least one magnet. In a preferred embodiment of the present invention, a tubular reactor space is used as reactor space. In a particularly preferred embodiment, an annular reactor is used as reactor space. The preferred use of an annular space as reactor space makes it possible on scaling up the process of the invention to match the maximum permissible paths in the magnetic separation (=gap width of the annular space) to the available magnetic forces. Both tubular reactors and annular reactors are known to those skilled in the art and are described, for example, in process engineering textbooks as tube reactors or loop reactors.

The reactor space according to the invention can in principle be arranged in any orientation which appears suitable to a person skilled in the art and allows a sufficiently high separating power of the process of the invention. For example, the reactor space can be arranged horizontally or vertically or at any angle between horizontal and vertical. In a preferred embodiment, the reactor space is arranged vertically. The aqueous dispersion to be separated can flow through the reactor space according to the invention in any possible direction. In the case of a vertically aligned reactor space, it is advantageous for the aqueous dispersion to be separated to flow through the reactor space from the top downward, so that the natural force of attraction acts on the aqueous dispersion and no additional mechanical devices, for example pumps, have to be used.

In general, the individual streams of the process of the invention can also be conveyed by means of the apparatuses known to those skilled in the art, for example pumps.

According to the invention, the aqueous dispersion is generally passed through a reactor space at a flow velocity which allows a sufficiently high separating power of the process of the invention. The flow velocity of the aqueous dispersion to be treated in the reactor space is from 0.01 to 5 m/s, preferably from 0.05 to 2 m/s, particularly preferably from 0.1 to 1 m/s.

In a preferred embodiment, the magnet is installed in a movable fashion on the outside of the reactor space. This preferred embodiment serves to move the magnet in the longitudinal direction of the reactor space in order to separate the magnetic constituents from the nonmagnetic constituents. As a result of the magnet moving, the magnetic constituents which are attracted by the magnetic field are likewise moved in the corresponding direction (stream I). However, the nonmagnetic constituents are not moved but are flushed away with the aqueous dispersion (stream II).

In a further preferred embodiment, the magnet is fixed in position on the outside of the reactor space and the magnetic field produced is movable. In this preferred embodiment, the entire magnet is not moved but instead the magnetic field moves within the magnet as a result of electronic control of a type known to those skilled in the art. This likewise results in the magnetic constituents being separated off in stream I while the nonmagnetic constituents remain in stream II.

The process of the invention can be carried out by the at least one magnet or the magnetic field produced, the aqueous dispersion to be separated, stream I and stream II moving in the same direction. In this embodiment, the reactor is operated in cocurrent.

In a further preferred embodiment of the process of the invention, the at least one magnet or the magnetic field produced move in the opposite direction to the aqueous dispersion to be separated, stream I and stream II move in opposite directions. In this preferred embodiment, the process of the invention is carried out in countercurrent.

In the countercurrent mode of operation according to the invention, care should be taken to ensure that movement of the magnetic constituents, preferably as a compact mass, in the direction opposite to the flow of the dispersion to be treated due to the at least one magnet does not occur in the feed line for the dispersion to be treated. In this case, blockages could occur in this region. In this embodiment of the process of the invention, the flow velocity of the aqueous dispersion to be treated is preferably ≥400 mm/s, particularly preferably ≥1000 mm/s. These high flow velocities ensure that no blockages occur in the process of the invention, in particular in countercurrent operation.

At least one magnet is installed on the outside of the reactor space. The magnets used according to the invention can be any magnets known to those skilled in the art, for example permanent magnets, electromagnets and combinations thereof. In a preferred embodiment, the at least one magnet is installed on the outside of the reactor space at a position at which a facility for allowing stream I and stream II to flow into the at least two different outlets is provided in the interior of the reactor space. This ensures that the magnetic field acts on the aqueous dispersion to be treated at a place where physical separation into stream I and stream II is possible.

The division of the reactor space according to the invention into the at least two outlets for stream I and stream II can be achieved by means of measures known to those skilled in the art, for example by means of appropriately shaped guide plates, funnels or tube branches.

In the process of the invention, the magnetic constituents in stream I are treated with a flushing stream. In a preferred embodiment, the magnetic constituents present in the dispersion accumulate at least in part, preferably in their entirety, i.e. in a proportion of at least 60% by weight, preferably at least 90% by weight, particularly preferably at least 99% by weight, on the side of the reactor space facing the at least one magnet as a result of the magnetic field. This accumulation of the magnetic constituents which is preferred according to the invention results in a compact mass comprising dispersion medium being present on the exterior wall of the reactor space and being moved in one direction by the magnet. However, this mass comprises included nonmagnetic particles which, were they to remain there, would lead to the abovementioned disadvantages in respect of efficiency and costs. As a result of the treatment according to the invention of the magnetic constituents in stream I, in particular the compact mass of magnetic constituents present on the exterior wall of the reactor, with a flushing stream, this mass is locally at least partly relayered. Included, nonmagnetic constituents are preferably released in this way. The released, nonmagnetic constituents are preferably transported away with the flushing stream while the magnetic constituents are moved by the magnetic field present (stream I).

According to the invention, a "flushing stream" is a stream which comprises neither magnetic constituents nor nonmagnetic constituents. In a particularly preferred embodiment, the flushing stream is water. However, it can also be any of the abovementioned combinations of water and solvents.

The flushing stream can, according to the invention, be added to stream I by all methods known to those skilled in the art, for example by means of nozzles, conventional feed lines, nozzles arranged in a ring, perforated plates and membranes and combinations thereof.

The flushing stream can, according to the invention, impinge on the magnetic constituents comprised in stream I at any angle which appears to be suitable to a person skilled in the art for a very high flushing action. In a preferred embodiment, the flushing stream meets stream I at an angle of from 60 to 120°, preferably from 80 to 100°, particularly preferably at right angles. The advantage of this preferred angle is that the greatest possible flushing action is obtained.

In the process of the invention, the magnetic constituents of the dispersion to be treated can be treated with the flushing stream from any direction or side of the reactor space which appears suitable to a person skilled in the art. It is possible, for example, for the flushing stream to be introduced on the side of the reactor space on which the magnetic constituents attracted by the magnet are located, preferably as a compact mass. In this embodiment, a particularly high degree of mixing of the compact mass of magnetic constituents is possible. It is also possible according to the invention for the flushing stream to be introduced on the side of the reactor space which is opposite the magnetic constituents attracted by the magnet, which are preferably present as a compact mass.

According to the invention, the aqueous dispersion to be treated is preferably conveyed through the reactor space by means of a pump P1. The flushing stream with which the magnetic constituents in stream I are treated is preferably conveyed by a pump P2. After the process of the invention has been carried out, the stream I obtained is conveyed by a pump P3. In a particularly preferred embodiment of the process of the invention, the flushing stream can be divided by the matched pumps P2 and P3, with the volume stream P2 being greater than the volume stream P3. This achieves backflushing of the nonmagnetic constituents at a defined volume flow into stream II.

The present invention also provides a reactor comprising a reactor space, at least one magnet installed on the outside of the reactor space, at least one inlet, at least one outlet for a stream I, at least one outlet for a stream II and at least one facility for treating stream I with a flushing stream.

In a preferred embodiment of the reactor of the invention, the at least one magnet is installed in a movable fashion on the outside of the reactor space.

In a further preferred embodiment, the at least one magnet is fixed in place on the outside of the reactor and the magnetic field produced is movable.

The at least one magnet installed on the outside of the reactor serves to separate magnetic constituents present in a dispersion which is treated in the reactor of the invention from nonmagnetic constituents which are likewise present in the dispersion. The magnetic constituents form stream I which can be treated and is preferably treated with a flushing stream in the reactor of the invention. The reactor space is preferably a tubular or annular reactor space. The facility for treating stream I with a flushing stream is, for example, a simple inlet into the reactor space or an arrangement of nozzles, for example nozzles arranged in a ring in the reactor, or a combination thereof.

Furthermore, the corresponding features which have been mentioned above in respect of the process apply analogously to the reactor of the invention.

The reactor of the invention is particularly suitable for separating magnetic constituents from mixtures which additionally comprise nonmagnetic constituents.

The present invention therefore also provides for the use of the reactor of the invention in the process of the invention. What has been said above in respect of the process of the invention and the reactor applies to this use.

FIGURES

The process of the invention and the reactor of the invention are illustrated below with the aid of FIGS. 1 to 5, with preferred embodiments being depicted in these figures.

The reference numerals used in the figures have the following meanings:

1 aqueous dispersion to be treated comprising magnetic and nonmagnetic constituents, e.g. ore suspension
2 stream I, product stream
3 reactor wall
4 annular space of the reactor
5 flushing stream

6 part of the flushing stream with which the nonmagnetic constituents are recirculated to the ore suspension

7 magnetic constituents after treatment

8 part of the flushing stream with magnetic constituents

9 tailings comprising nonmagnetic constituents

FIG. 1 shows the in-principle structure of a magnetic separator in which the ore suspension is conveyed by means of pump P1 through an annular space (1).

The magnetic particles or particle combinations (2) which have been separated off are moved by means of suitable control of the magnets along the wall (3) in a concentrically arranged annular space (4). There, this product stream (2) is relayered by means of a specifically conducted flushing stream (5) and the nonmagnetic components are thus recirculated with part of the flushing stream (6) to the ore suspension (1). The division of the flushing stream is effected by the matched pumps P2 and P3, where: volume flow P2>volume flow P3. The purified magnetic particles or magnetic particle combinations (7) are discharged from the magnetic separator at the end of the magnets together with the part of the flushing stream (8) discharged in a targeted manner by means of pump P3 as purified concentrate.

EXAMPLES

Example 1

Figure 1:
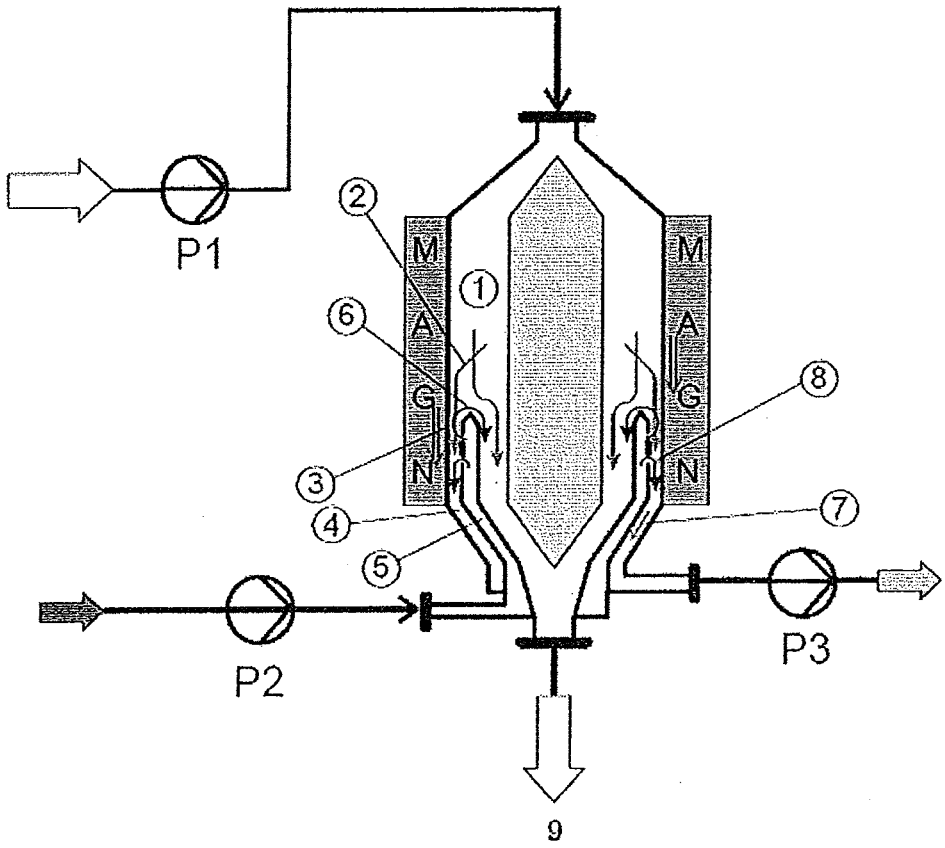
Figure 2:
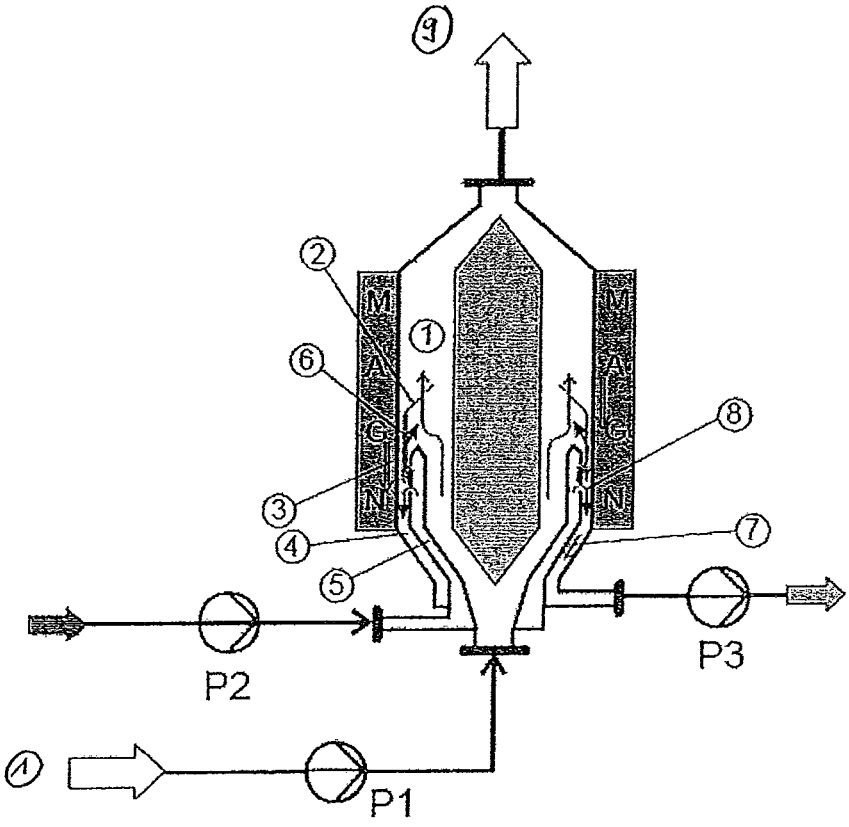
FIG. 2 shows the equivalent arrangement of FIG. 1 in countercurrent operation. The flushing stream has to be fed in such a way that the magnetically deposited layer of solids which is moved along the wall by means of the magnets is locally relayered and included nonmagnetic components are in this way set free and transported away with the flushing stream.
Figure 3:
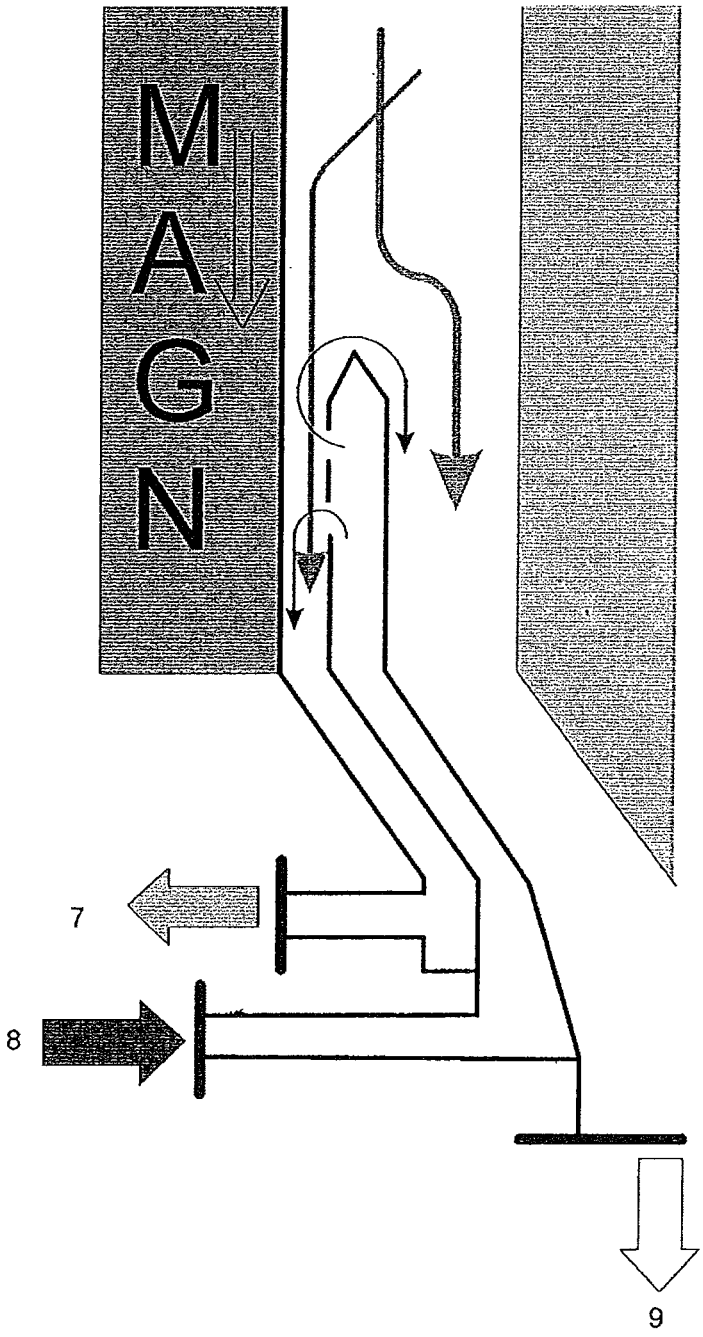
FIG. 3 shows a possible arrangement in which the flushing stream is introduced via holes in a wall opposite the magnet wall. This arrangement allows distribution of the flushing stream inlet points over a large area.
Figure 4:
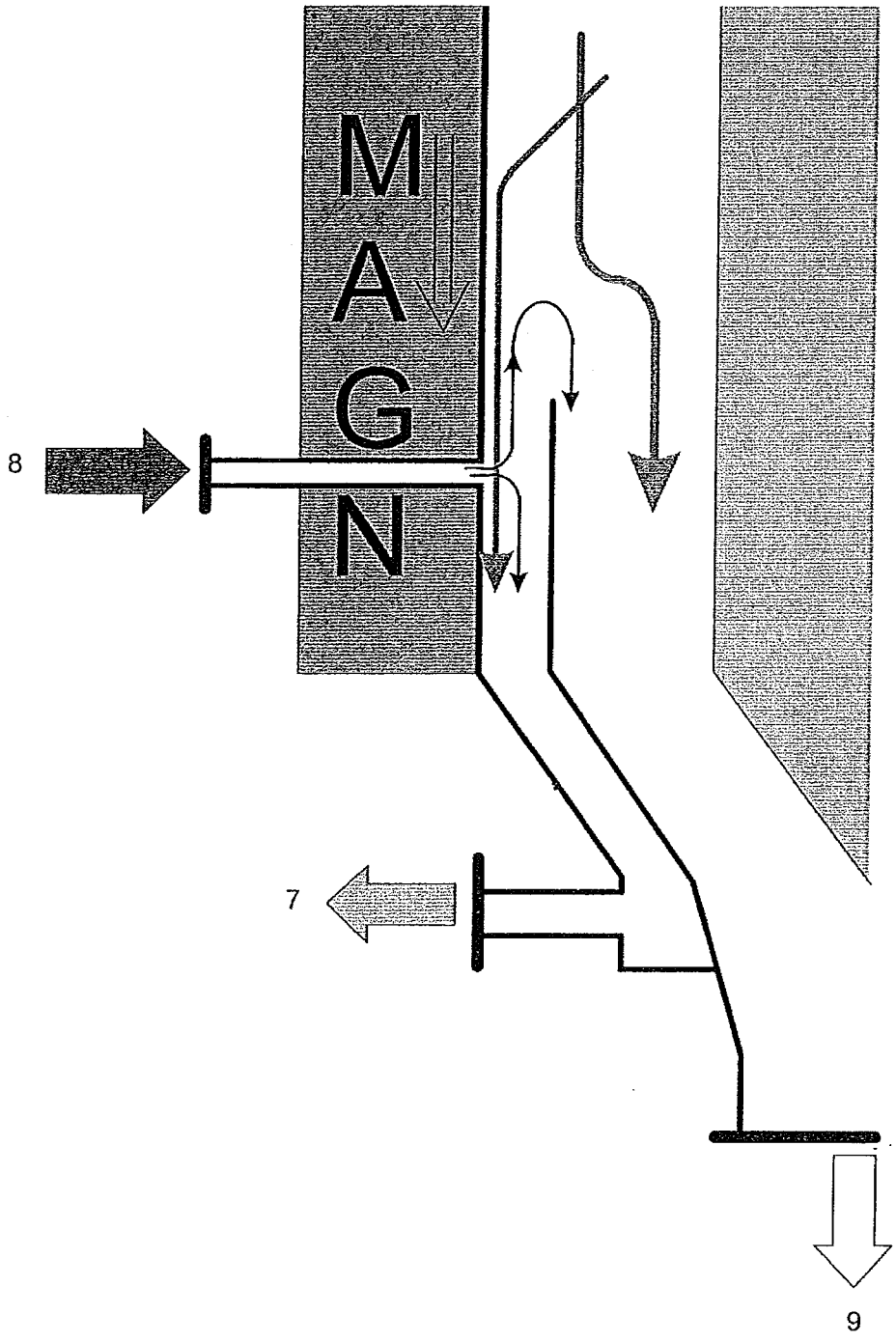
FIG. 4 shows the arrangement in which the flushing stream is conveyed through the layer of solids on the magnet wall and optimal liberation of the nonmagnetic components is achieved in this way.
Figure 5:
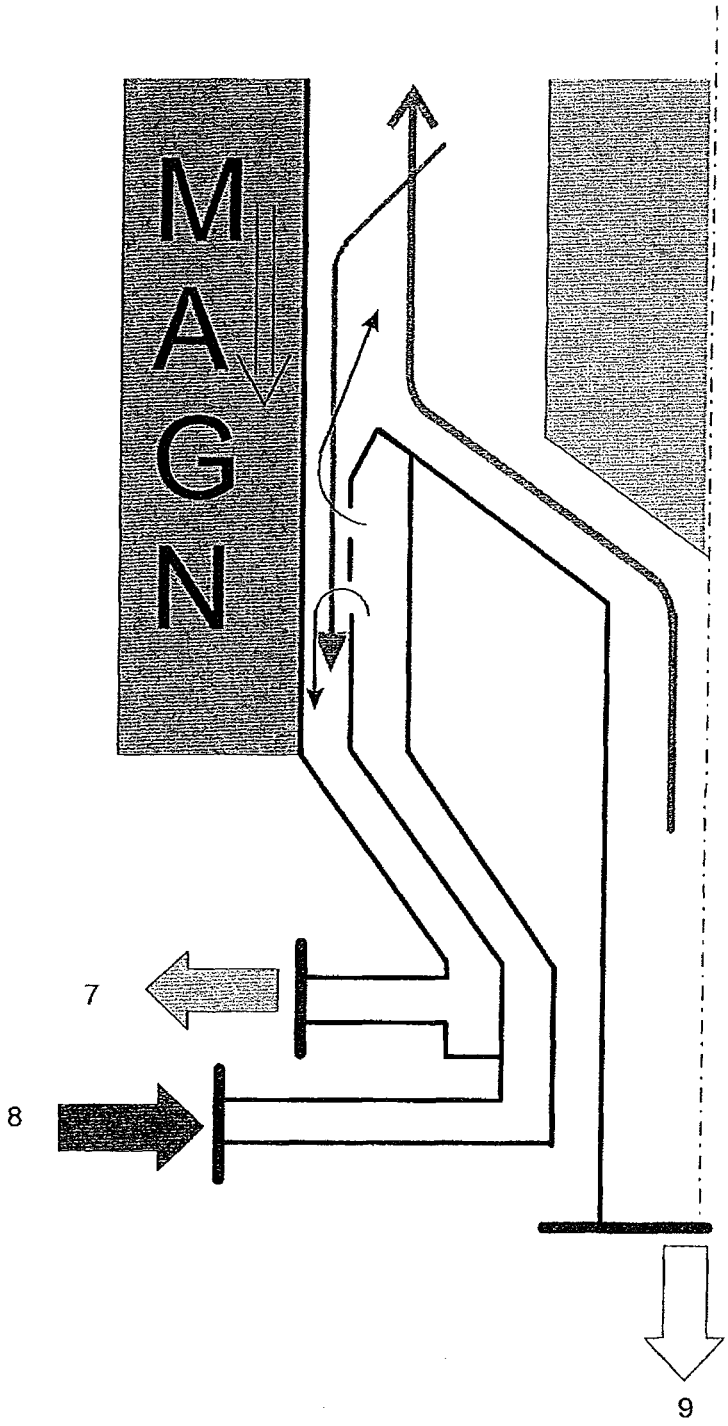
FIG. 5 shows a possible arrangement for introduction of the suspension, in which large distances to the magnets and thus small magnetic forces are ensured by oblique inflow of the suspension. At a sufficient flow velocity, which in this embodiment should be above 1000 mm/s, possible blockages can be prevented in this way.

Example 1 shows the influence of the flushing on the content of nonmagnetic material in the concentrate.

The experiments are carried out in cocurrent using an ore suspension having a solids content of about 10% by weight. The flow velocity of the suspension is about 10-13 cm/s. The magnets move at the same velocity as the suspension.

The first experiment is carried out without a flushing stream. In this case, about 17% by weight of the solid is discharged in the concentrate stream (stream I). The desired material is concentrated from 0.36% by weight in the aqueous dispersion to be treated to 1.6% by weight in stream I.

In a further experiment according to the invention, a flushing stream is used. In this case, about 5% by weight of the solid is discharged in the concentrate stream (stream I). The desired material is concentrated from 0.36% by weight to 3.9-4.6% by weight.

The amount of desired material discharged is the same in both experiments.

Example 2

This example demonstrates the influence of the flow pattern.

The experiments are carried out using a miniplant. The suspension is pumped through a glass tube having a branch at which permanent magnets are moved by means of a toothed belt so that the magnetic fraction is conveyed into the branch.

The flow in the branch (stream I) is kept constant by means of a pump and is about 10% by volume of the stream of suspension.

The experiments are carried out using model ore suspensions, i.e. a mixture of desired material and silica sand, having a solids content of about 25% by weight. The flow velocity is about 10 cm/s (cocurrent and countercurrent relative to movement of the magnets). The magnets move at about 20 cm/s.

In the experiment using the cocurrent mode of operation, about 60-70% of the desired material are found in the concentrate stream (stream I). In the experiment using the countercurrent mode of operation, about 95-99% of the desired material are found in the concentrate stream (stream I).

The invention claimed is:

1. A process for separating agglomerates of ore mineral and at least one magnetic particle as magnetic constituents from an aqueous dispersion comprising these magnetic constituents and the gangue of the ore as nonmagnetic constituents, comprising:

passing the aqueous dispersion through a reactor space in which the aqueous dispersion is separated by at least one magnet installed on the outside of the reactor space into at least one stream I comprising magnetic constituents and at least one stream II comprising nonmagnetic constituents; and treating the magnetic constituents in stream I with a flushing stream.

2. The process according to claim 1, wherein the at least one magnet is installed in a movable fashion on the outside of the reactor space.

3. The process according to claim 2, wherein the at least one magnet or the magnetic field produced, the aqueous dispersion to be separated, and stream I and stream II move in the same direction.

4. The process according to claim 2, wherein the at least one magnet or the magnetic field produced move in the opposite direction to the aqueous dispersion to be separated, stream I and stream II.

5. The process according to claim 1, wherein the at least one magnet is fixed in place and the magnetic field produced is movable.

6. The process according to claim 1, wherein the magnetic constituents in stream I are moved as a solid layer on a reactor wall facing the at least one magnet.

7. The process according to claim 1, wherein the flushing stream meets stream I at an angle of from 60 to 120°.

8. The process according to claim 1, wherein the aqueous dispersion comprises 0.1 to 10% by weight of magnetic constituents, 5 to 50% by weight of nonmagnetic constituents, and water.

9. The process according to claim 1, wherein the flow velocity of the aqueous dispersion passing through the reactor is 0.01 to 5 m/s.

10. A reactor, comprising:

a reactor space, at least one magnet installed on the outside of the reactor space, at least one inlet, at least one outlet for a stream I, at least one outlet for a stream II, and at least one facility for treating stream I with a flushing stream.

11. The reactor according to claim 10, wherein the at least one magnet is installed in a movable fashion on the outside of the reactor space.

12. The reactor according to claim 10, wherein the at least one magnet is fixed in place on the outside of the reactor and the magnetic field produced is movable.

13. The reactor according to claim 10, wherein the reactor is being fed an aqueous dispersion comprising 0.1 to 10% by weight of magnetic constituents, 5 to 50% by weight of nonmagnetic constituents, and water.

14. A process for separating agglomerates of ore mineral and at least one magnetic particle as magnetic constituents from an aqueous dispersion comprising these magnetic constituents and the gangue of the ore as nonmagnetic constituents, comprising:

passing the aqueous dispersion through a reactor space of the reactor of claim 10 in which the aqueous dispersion is separated by at least one magnet installed on the outside of the reactor space into at least one stream I comprising magnetic constituents and at least one stream II comprising nonmagnetic constituents; and treating the magnetic constituents in stream I with a flushing stream.

* * * * *

UNITED STATES PATENT AND TRADEMARK OFFICE

CERTIFICATE OF CORRECTION

PATENT NO. : 8,646,613 B2
APPLICATION NO. : 13/504519
DATED : February 11, 2014
INVENTOR(S) : Reinhold Rieger et al.

It is certified that error appears in the above-identified patent and that said Letters Patent is hereby corrected as shown below:

On the title page, Item (12), the Letters Patent Heading, and Item (75), the 1st Inventor's Last Name are incorrect. Items (12) and (75) should read:

--(12) United States Patent
Rieger et al.

(75) Inventors: Reinhold Rieger, Offstein (DE);
Juergen Oswald, Frankenthal (DE)--

Signed and Sealed this
Twenty-ninth Day of April, 2014

Michelle K. Lee

Michelle K. Lee
*Deputy Director of the United States Patent and Trademark Office*